US006688595B2

(12) United States Patent
Hajianpour

(10) Patent No.: US 6,688,595 B2
(45) Date of Patent: Feb. 10, 2004

(54) APPARATUS AND METHOD FOR WATER JUMPING GAME

(76) Inventor: Mohammed A. Hajianpour, 1706 Vestal Dr., Coral Springs, FL (US) 33071

( * ) Notice: Subject to any disclaimer, the term of this patent is extended or adjusted under 35 U.S.C. 154(b) by 199 days.

(21) Appl. No.: 10/035,936

(22) Filed: Dec. 24, 2001

(65) Prior Publication Data

US 2002/0084583 A1 Jul. 4, 2002

Related U.S. Application Data

(60) Provisional application No. 60/258,796, filed on Dec. 29, 2000.

(51) Int. Cl.[7] ..... A63F 7/07

(52) U.S. Cl. ..... 273/108.57; 239/7; 472/128; 273/457

(58) Field of Search ..... 273/108.51, 108.52, 273/108.53, 108.54, 108.55, 108.56, 108.57, 457; 472/128; 239/7

(56) References Cited

U.S. PATENT DOCUMENTS

| | | | | |
|---|---|---|---|---|
| 2,954,932 A | * | 10/1960 | Albano | 239/723 |
| 4,739,985 A | * | 4/1988 | Rudell et al. | 482/81 |
| 5,672,123 A | * | 9/1997 | Rudell et al. | 473/414 |
| 6,592,055 B1 | * | 7/2003 | Marino | 239/275 |

* cited by examiner

*Primary Examiner*—Jessica Harrison
*Assistant Examiner*—Corbett B. Coburn
(74) *Attorney, Agent, or Firm*—Ronald V. Davidge

(57) ABSTRACT

A device for determining whether a rotating stream of water from a sprinkler has been successfully jumped by a person at a player position includes a first sensor generating an first signal as the stream of water passes a first location and a second sensor generating a second signal as the stream of water passes a second location, which is aligned with the player position. The device determines whether the second signal follows the first, indicating whether the stream of water has been blocked by the person, having failed to jump. The device then provides an audible of visible indication as a result of this determination. The device may also display a count of successful jumps.

20 Claims, 4 Drawing Sheets

APPARATUS AND METHOD FOR WATER JUMPING GAME

This application claims benefit of provisional application No. 60/258,796, filed on Dec. 29, 2000.

BACKGROUND OF THE INVENTION

1. Field of the Invention

This invention relates to recreational apparatus and, more particularly, to apparatus associated with a game of jumping a stream of water from a water sprinkler.

2. Background Information

Many people, especially children, play various kinds of games in a water stream generated from a rotary sprinkler or a garden hose, with obvious benefits of cooling on a hot day, recreation, and exercise. However, such games tend to lack a structure or objectives, other than getting wet, or conceivably getting others wet instead, so that their participants usually quickly tire of the water play. What is needed is a method and apparatus providing an objective for such a game and an automatic means for scoring such a game.

One of the present trends in recreation is an increasing use of technology to provide structure and definite objectives to traditional types of games otherwise lacking these qualities. For example, while various types of tag games and games simulating armed conflict in the context of a war or in the context of "cops and robbers" have been played for generations, recent technological innovations in the form of laser devices and paint ball guns have provided structure and objectives against which progress is easily measured. What is needed is a method and device providing a simple and reliable method for tracking the actions of an individual against a predetermined objective during water play using a stream of water from a lawn sprinkler.

SUMMARY OF THE INVENTION

According to a first aspect of the invention, a method is provided for use in a game of jumping a rotating stream of water from a sprinkler as the stream of water moves across a player position, wherein the method includes steps of:

a) deploying a first sensor at a first location to generate a first signal in response to movement of the stream of water across the first location, wherein the stream of water moves across the first location before the player position;

b) deploying a second sensor at a second location to generate a second signal in response to movement of the stream of water across the second location, wherein the stream of water moves across the player position and the second location simultaneously;

c) determining whether the stream of water moves across the second location after moving across the first location in response to receiving the first and second signals within a microprocessor; and d) providing a human perceivable indication in response to a determination made in step c) of whether the stream of water moves across the second location after moving across the first location.

In accordance with a first embodiment of the invention, step c) includes receiving the first signal within the microprocessor and then determining whether the second signal is received within the microprocessor during an allowable actuation time.

In accordance with a second embodiment of the invention, step c) includes receiving the first signal within the microprocessor, determining that the first signal has ended, and then determining whether the second signal is received after the first signal has ended and before receiving the first signal within the microprocessor again.

This method is preferably carried out in an apparatus including the first and second sensors, the microprocessor, a battery and a switch within a housing including a base portion and a sliding portion which is slid into an open position extending outward from the base portion. Sliding the sliding portion into the open position closes the switch to provide electrical power from the battery to the microprocessor and to begin an initialization operation within the microprocessor, which includes starting execution of a program within the microprocessor.

DETAILED DESCRIPTION OF THE INVENTION

Figure 1:
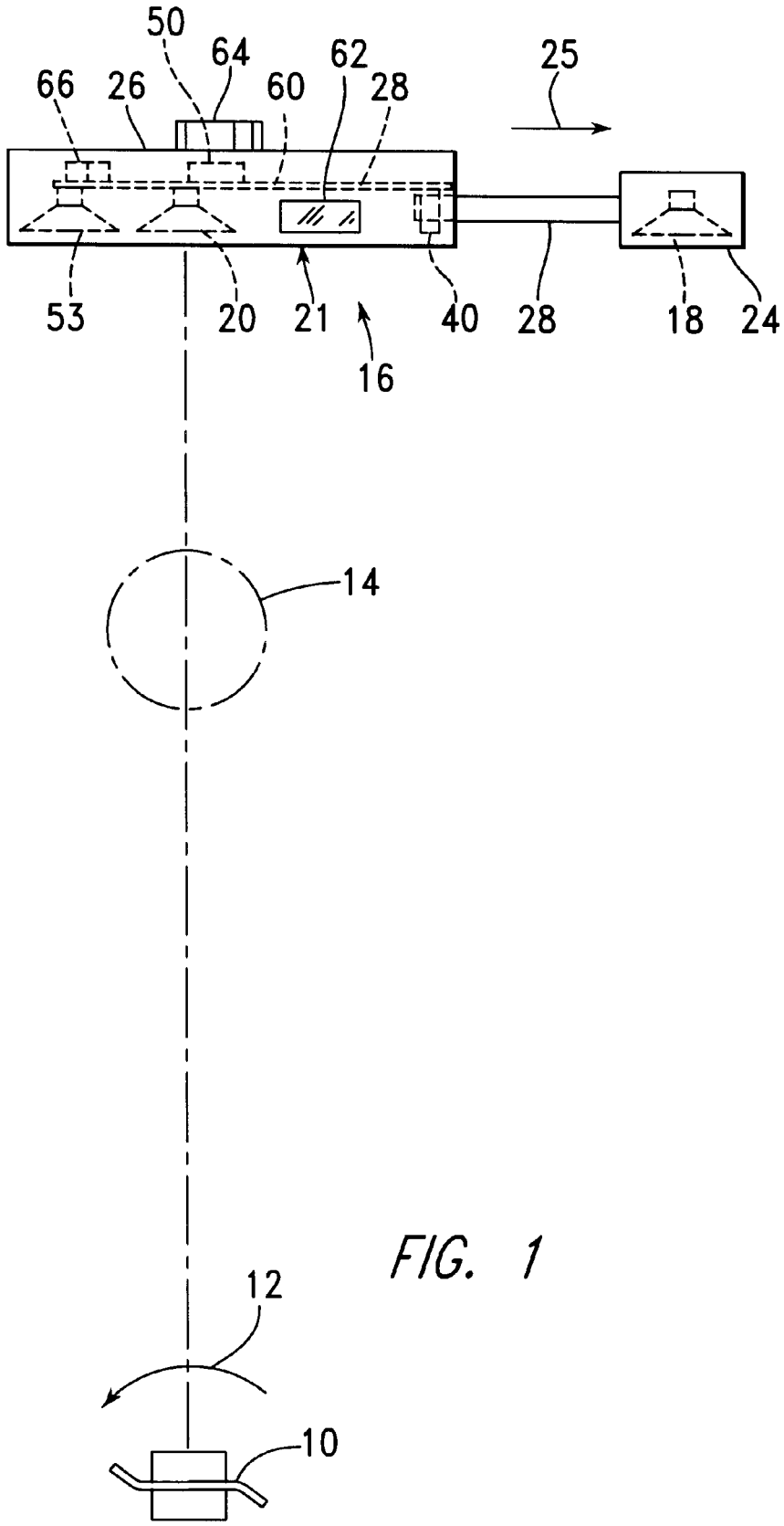
FIG. 1 is a plan view showing electronic game apparatus built in accordance with the present invention and method for playing a water game using this apparatus.

Referring to FIG. 1, the object of a water jumping game is to successfully jump over a stream of water emanating from a conventional rotary water sprinkler 10, which rotates in the direction of arrow 12. The person playing the game stands at a player position indicated by circle 14, between the sprinkler 10 and electronic game apparatus 16.

The electronic game apparatus 16 includes a first sensor 18 and a second sensor 20, each of which provides an output when an adjacent part of the apparatus is struck by a stream of water. For example, each sensor 18, 20 may be a microphone providing an electrical output signal in response to a noise generated by a stream of water impinging upon the housing 21 of the electronic game apparatus 16 in an area near the sensor 18, 20. Output signals from the sensors 18, 20 are provided as input signals to a control circuit 22 within the electronic game apparatus 16.

Preferably, each sensor 18, 20 is a conventional type of microphone well known to those skilled in the related arts. For example sensors 18, 20 may be dynamic microphones, which, while being generally built in the manner of audio speakers, are used to change audible vibrations into electrical signals, instead of to change electrical signals into audible vibrations. That is, each of the sensors 18, 20 may include a flexible conical diaphragm to which a voice coil is attached, with the voice coil extending within the magnetic field of a permanent magnet. In this device, the conical diaphragm vibrates in response to acoustic sound, such as the sound produced by a stream of water striking an adjacent portion of the housing 21. The resulting vibration of the voice coil with the conical diaphragm causes an electrical signal to be generated within the voice coil. This electrical signal is readily amplified to produce a signal driving various devices.

Alternately, the sensors 18, 20 may be capacitor types, also well known to those skilled in the relevant arts, in which a thin metallized plastic foil, supported in close proximity to a fixed plate, is charged through a large resistor with a bias voltage. The acoustic vibrations then vary the voltage between the foil and the plate with changes in capacitance, in a manner allowing the changes in voltage to be amplified to drive a device.

Preferably, the housing 21 is divided into a sliding housing 24 and a base housing 26, with the sliding housing 24, in which the first sensor 18 is mounted, being slidably mounted within the base housing 26. This arrangement allows a narrowed section 28 of the sliding housing 24 to be moved into the base housing 26, minimizing the space required for storage of the apparatus 16, and to be subsequently extended, in the direction of arrow 25, into the configuration of FIG. 1, providing for operation of the apparatus 16.

Figure 2:
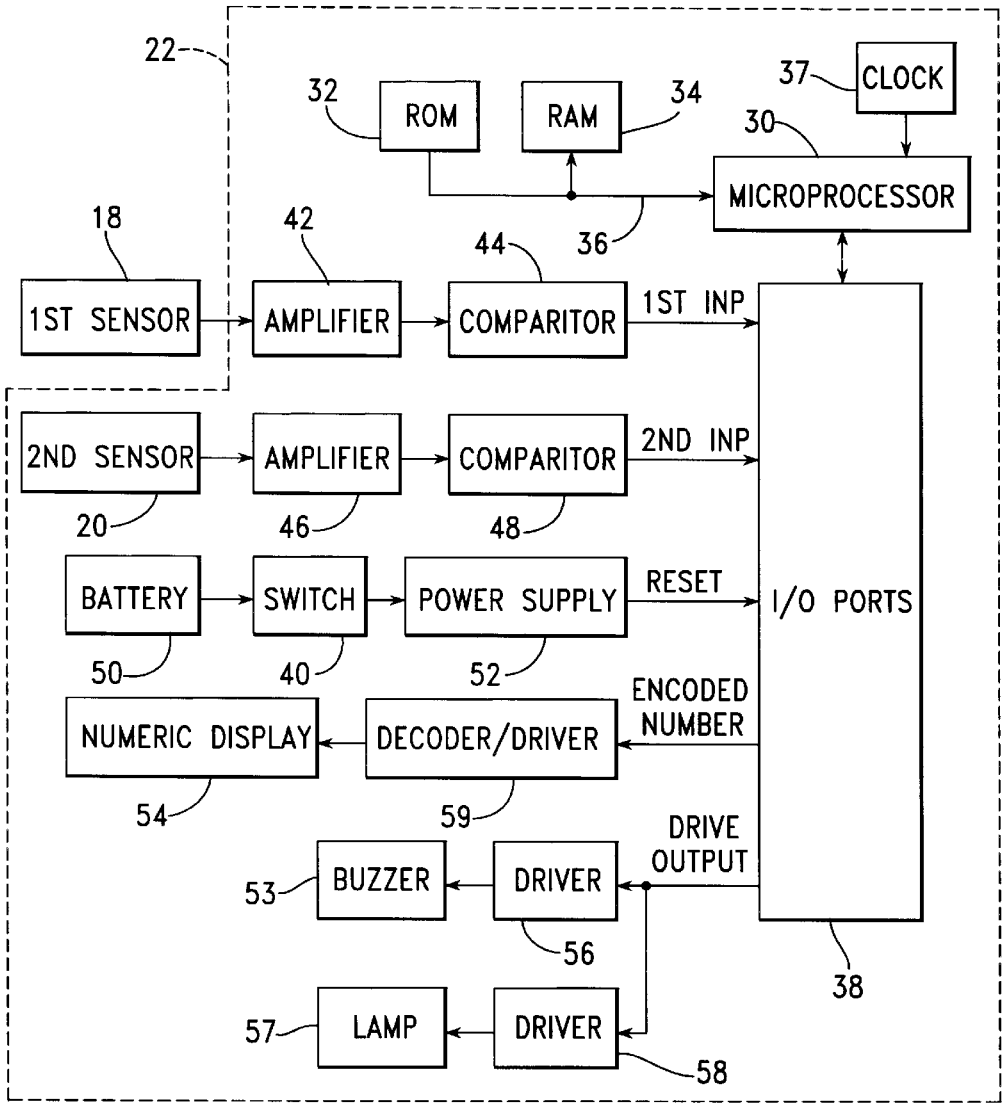
FIG. 2 is a block diagram of a control circuit within the apparatus of FIG. 1.

FIG. 2 is a block diagram of the control circuit 22 within the electronic game apparatus 16. This control circuit 22 includes a microprocessor 30 connected to a ROM (read only memory) 32 and to a RAM (random access memory) 34 by means of a system bus 36. The ROM 32 stores instruction steps and data required for the execution of a program within the microprocessor 30. The RAM 36 stores data placed therein by the microprocessor 30 as a result of execution of a program having instruction steps stored in ROM 34. Optionally, some or all of the program steps stored in ROM 32 may be loaded into RAM 34 before execution within the microprocessor 30, which can access data and instruction steps from both the ROM 32 and the RAM 36. Typically, the RAM 34 is volatile, so that data stored within it is lost when electrical power is turned off within the control circuit 22, while the ROM 32 is nonvolatile, so that program instructions and data stored within it is not lost when electrical power is turned off. While the ROM 32 needs only to be read, not written to, a programmable device, such as an EEPROM (electrically erasable programmable read only memory) can be used to provide its function.

The control circuit 22 also includes a clock 37 providing pulses that are counted to determine an elapsed time occurring between events. These clock pulses may be used only for this purpose, or they may also be used to control other operations occurring within the control circuit 22.

The microprocessor 30 is also connected to a circuit module 38 providing a number of I/O (input/output) ports through which data is supplied as an input to the microprocessor 30, and through which data is provided as an output from the microprocessor 30.

Within the control circuit 22, input signals to the microprocessor 30 are provided in response to output signals from the sensors 18, 22, and in response to the operation of a reset switch 40. An output signal from the first sensor 18 is provided as an input to an amplifier 40 within the control circuit 22. (If the sensor 18 is a capacitor-type microphone, a pre-amplifier (not shown) may additionally be placed near the sensor 18.) The output signal fro 111 m the amplifier 40 is provided as an input to a comparator 44, which compares this signal with a predetermined voltage reference. If this signal from the amplifier 40 is sufficiently high, the comparator 44 with a 1ST INPUT signal having a high (logic level 1) level. If the signal from the amplifier 40 is not sufficiently high, the 1ST INPUT signal has a low (logic level 0) level. Similarly, an output signal from the second sensor 20 is provided as an input to a amplifier 46, which in turn provides an output signal as an input to a comparator 48. If the signal from the amplifier 46 is sufficiently high, the 2ND INPUT signal, provided as an input to the microprocessor 30 from the comparator 48 has a high level; otherwise this signal has a low level.

Power to drive the various electronic components within the electronic game apparatus 16 is derived from a battery 50. A power supply 52 derives various voltage levels required by these components from the single voltage level supplied by the battery 50 and provides a RESET signal as an input to the microprocessor 30. The RESET signal appears as soon as voltage levels sufficient for reliable operation been restored after the system power is turned on. Thus, in the example of FIG. 2, the user of the apparatus 16 resets the control circuit 22 by turning electrical power off and on. Alternately, a separate reset switch (not shown) may be provided for resetting the control circuit 22 without interrupting electrical power.

Within the control circuit 22, output signals from the microprocessor 30 are used to operate a buzzer 53 indicating that a jump of the water stream has been missed, and, optionally, to increment a number displayed by a numeric display 54 to indicate the number of times that such a jump has been successfully completed since it was last missed.

Thus, a DRIVE OUTPUT signal is provided as an output from the microprocessor 30 to a driver circuit 56, causing the driver circuit 56 to drive the buzzer 53 electrically. Preferably, the buzzer 53 is a well known, conventional type of transducer. For example, the buzzer 53 may be an electromechanical device vibrating to produce a audible sound in response to a driving voltage supplied by the driver circuit 54. Alternately, the buzzer 53 may be a speaker driven at an audible frequency generated within the driver circuit 54.

Optionally, the electronic game apparatus 16 includes an indicator lamp 57 operated by a driver circuit 58 to provide a visual indication in response to the DRIVE OUTPUT signal. In general, the electronic game apparatus 16 is understood to include an indicator for providing a user-perceivable indication in response to the microprocessor 30. The user-perceivable indication may be an audible indication, a visible indication, or both.

Optionally, an ENCODED NUMBER signal is additionally provided as an output from the microprocessor 30 to a decoder/driver circuit 59. For example, the number may be supplied in a binary coded decimal (BCD) format conventionally to drive this type of circuit. The decoder/driver circuit 59 then decodes the number and drives the appropriate LED segments within the numeric display 54, so that a number corresponding to the ENCODED NUMBER signal is displayed. A multiple-digit number may be displayed in a multiplexed manner by sequentially driving the LED segments corresponding to individual digits with signal patterns developed to represent each of the individual digits.

Referring additionally to FIG. 1, the various elements described above in reference to FIG. 2, except for the first sensor 18, are advantageously attached to a single circuit card 60, with the numerical display 54 being visible through a transparent window 62 in the base housing 26, and with the battery 50 being removably held within clips attached to the circuit card 60. The housing 21 protects the devices within it from moisture, being fitted, for example, with a threaded cap 64 engaging a gasket (not shown), with the cap 64 being removed and reinstalled when it is necessary to change the battery 50.

The reset switch 40 is preferably positioned to be actuated by moving the sliding housing 24 in the direction of arrow 25, with electrical power within the electronic game apparatus 16 being turned on only when the sliding housing 24 is fully extended from the base housing 26 in the direction of arrow 25.

Optionally, the electronic game apparatus 16 includes one or more additional switches 66 operable by depression of a flexible portion of the base housing 26. These switches may be used to initiate changes in the mode of operation of the apparatus 16, such as changing the sequence in which the outputs of the first and second sensors 18, 20 are examined to difference in the direction of rotation of the water sprinkler 10 or changes in the time allowed for a response to correct for a difference in the speed of rotation of the water sprinkler 10.

Figure 3:
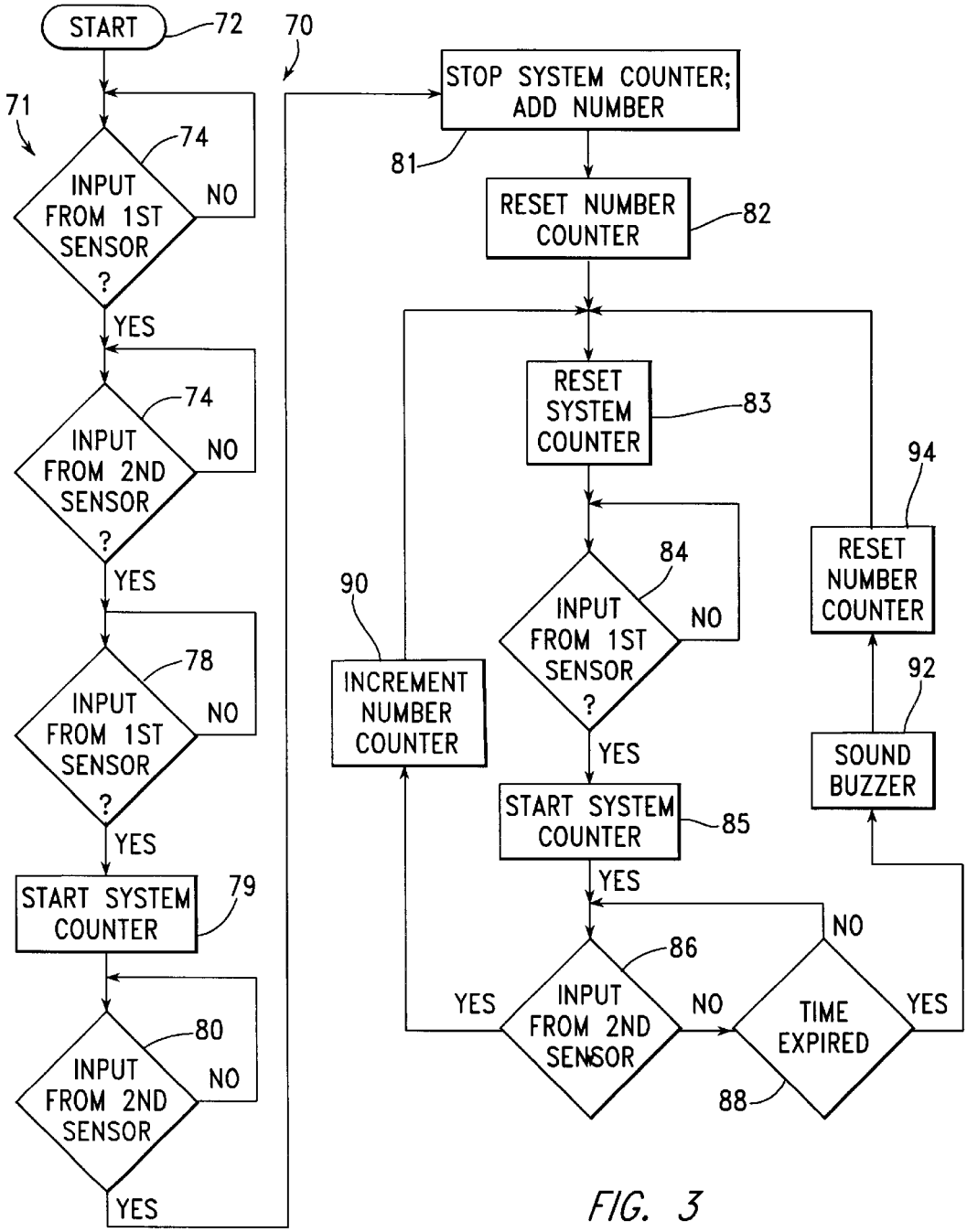
FIG. 3 is a flow chart showing operation of a routine executing within a microprocessor in the control circuit of FIG. 2 in accordance with a first embodiment of the invention.

FIG. 3 is a flow chart showing operation of a program 70 executing in the microprocessor 30 in accordance with a first embodiment of the invention. This program begins in step 72, after the execution of an initialization routine following the application of electrical power by closing the switch 40, for example, by fully extending the sliding housing 24. During execution of the program 70, the microprocessor 30 maintains a system counter, which is incremented by counting pulses from the clock 37. If the electronic game apparatus 16 includes the optional numeric display 54, the microprocessor 30 also maintains a number counter, which indicates the number of times that the water stream has been successfully jumped following the start of the game or the last previous failure to jump the water stream.

After the program 70 is started, a start up routine 71 operates to determine the time between inputs from the first and second sensors 18, 20, with this time being determined by the characteristics of the conventional sprinkler 10. First, the system waits for an input to the microprocessor 30 from the first sensor 18. When such an input occurs, as determined in step 74, the system waits for an input to the microprocessor 30 from the second sensor 20. After such an input occurs, as determined in step 76, the system waits for a second input of the first sensor 18. The time between the first input from the first sensor 18 and the first input from the second sensor 20 is not used in the start up routine 71 because the sprinkler may be coming up to a steady rotational speed of operation.

Thus, after a second input to the microprocessor 30 from the first sensor 18 occurs, as determined in step 78, the system begins counting pulses from the clock circuit 37 in step 79 to measure an elapsed time. Next, when an input occurs from the second sensor 20, as determined in step 80, the system stops counting pulses and adds a predetermined number to the pulse count in step 81 to determine an allowable count representing an allowable actuation time. The predetermined number allows satisfactory operation of the apparatus 16 under conditions of variations in the rotational speed of the sprinkler 10.

From this time, the game may be played. First the number counter is reset in step 82. Then, the system counter system counter is reset in step 83. After an input from the first sensor 18 occurs, as determined in step 84, the system begins counting pulses in step 85. If an input from the second sensor 20 occurs, as indicated in step 86, before the allowable count is reached, as determined in step 88 to indicate that time has expired, the number counter is incremented in step 90 to indicate that the water stream has been successfully jumped, allowing water to reach the apparatus 16 in a way causing an input to the microprocessor 30 from the second sensor 20. On the other hand, if the allowable count is reached, as indicated in step 88, without an input to the microprocessor 30 from the second sensor 20, the buzzer 70 is sounded in step 92 to indicate that the person playing the game has failed to jump the stream of water, so that the water has not reached the apparatus 16 to cause an input to the microprocessor 30 from the second sensor 20. When the buzzer is sounded in step 92, the number counter is reset in step 94 to begin counting successful jumps in succeeding instances of step 90.

While the program 70 has been described as including an automatic process for determining the allowable actuation time, a manually adjusted control, provided through the use of a switch 66, can alternately be used for this purpose.

Figure 4:
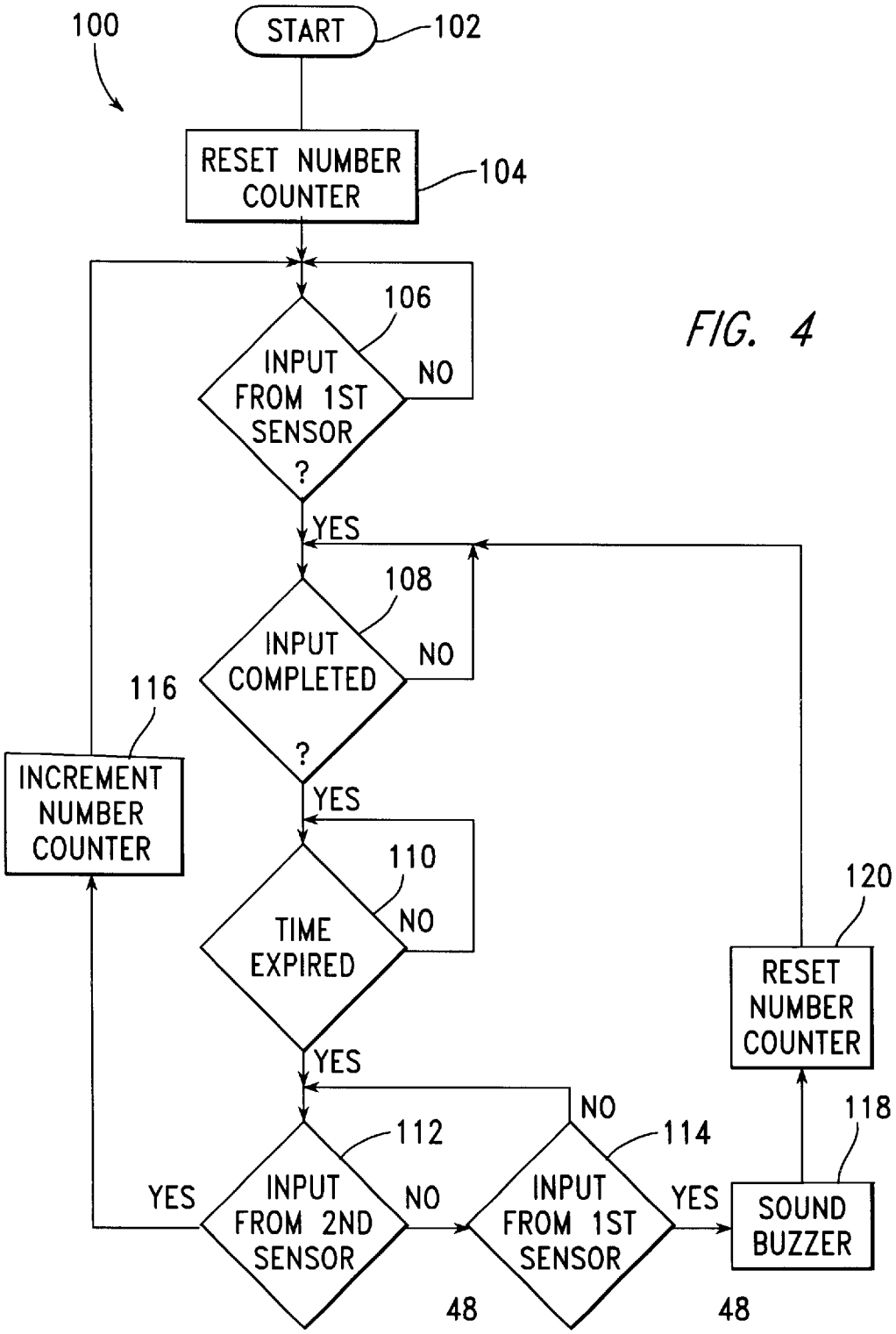
FIG. 4 is a flow chart showing operation of a routine executing within a microprocessor in the control circuit of FIG. 2 in accordance with a second embodiment of the invention.

FIG. 4 is a flow chart showing operation of a program 100 executing in the microprocessor 30 in accordance with a second embodiment of the invention. This program begins in step 102, after the execution of an initialization routine following the application of electrical power by closing the switch 40, for example, by fully extending the sliding housing 24. The program 100 is designed to take advantage of the fact that, if the water stream is interrupted by a player, two inputs from the first sensor 18 to the microprocessor 30 will occur in succession, while, if the water stream is not interrupted by a player, i.e. if a successful jump is made, each input from the first sensor 18 is followed by an input from the second sensor 20. As described above in reference to FIG. 3, if the electronic game apparatus 16 includes the optional numeric display 54, the microprocessor 30 maintains a number counter, which indicates the number of times that the water stream has been successfully jumped following the start of the game or the last previous failure to jump the water stream.

After the program 100 is started in step 102, the number counter is reset in step 104. Then, after a determination is made in step 106 that an input to the microprocessor 30 from the first sensor 18 has occurred, a determination is made in step 108 that this input has been completed. Then, in step 110. a determination is made that a predetermined delay time has expired. In this way, it is ensured that the water stream has in fact passed by the portion of the housing 21 adjacent the first sensor 18, since a determination in step 108 may otherwise result from a temporary change in the intensity of water striking the housing 21 during, instead of following, such a passage of the water stream. Then in steps 112 and 114, a determination is made that an input from the second sensor 20 has occurred or that another input from the first sensor 18 has occurred. The system continues moving through these steps 112, 114 until one of these inputs occurs.

If the input to the microprocessor 30 from the second sensor 20 occurs first, as determined in step 112, the system proceeds to step 116, in which the number counter is incremented to indicate that the water stream has been jumped successfully, allowing water to strike the housing 21 near the second sensor 20. The system then returns to step 106 to wait for the next input from the first sensor 18.

On the other hand, if the input to the microprocessor 30 occurs first, as determined in step 114, the buzzer is sounded in step 118 to indicate that the person playing the game has failed to jump the water stream, and therefor has blocked the water stream from reaching the housing 21 in a location adjacent the second sensor 18. Then, in step 120, the number counter is reset to zero to begin a new count of successful jumps following this failed jump.

If the electronic game apparatus 16 does not include the optional numeric display 59, there is no number counter, so that steps 82, 90, and 94 of FIG. 3 and steps 104, 116, and 120 of FIG. 4 are eliminated, with the system proceeding directly from the steps preceding these steps to the steps following them, as described above in reference to FIGS. 3 and 4.

As described above in reference to FIG. 2, a lamp 57 may be used in step 92 of FIG. 3 and in step 118 of FIG. 4 to provide a visual indication instead of, or in addition to, the audible indication of the buzzer 53. While the use of a buzzer or a lamp to provide a human perceivable indication has been described as being used to indicate a failure to jump the water stream, as evidenced by the water stream being blocked from striking the housing 21 near the second sensor 20, it is understood that such a human perceivable indication can instead by given to indicate a successful jump, as evidenced by the water stream striking the housing 21 near the second sensor 20.

While the invention has been described in its preferred forms or embodiments with some degree of particularity, it is understood that this description has been given only by way of example and that numerous changes in the combination and arrangement of parts and process steps may be made without departing from the spirit and scope of the invention.

What is claimed is:

1. A method for use in a game of jumping a rotating stream of water from a sprinkler as said stream of water moves across a player position, wherein said method comprises steps of:

a) deploying a first sensor at a first location to generate a first signal in response to movement of said stream of water across said first location, wherein said stream of water moves across said first location before said player position;

b) deploying a second sensor at a second location to generate a second signal in response to movement of said stream of water across said second location, wherein said stream of water moves across said player position and said second location simultaneously;

c) determining whether said stream of water moves across said second location after moving across said first location in response to receiving said first and second signals within a microprocessor; and d) providing a human perceivable indication in response to a determination made in step c) of whether said stream of water moves across said second location after moving across said first location.

2. The method of claim 1, wherein steps c) and d) are repeated.

3. The method of claim 2, wherein step c) includes steps of:

e) receiving said first signal within said microprocessor; and f) determining whether said second signal is received within said microprocessor during an allowable actuation time after receiving said first signal.

4. The method of claim 3, wherein said allowable actuation time is determined between steps b) and c) by a method including steps of:

g) receiving said first signal within said microprocessor;

h) counting timing pulses following step e);

i) receiving said second signal within said microprocessor; and j) adding a predetermined number to a number of pulses counted between steps g) and i) to determine a number of timing pulses occurring during said allowable actuation time.

5. The method of claim 4, wherein step g) is preceded by a method providing time for said sprinkler to reach a steady rotational speed comprising steps of k) receiving said first signal within said microprocessor; and l) receiving said second signal within said microprocessor.

6. The method of claim 2, wherein step c) includes steps of:

m) receiving said first signal within said microprocessor;

n) determining that said first signal has ended; and o) determining whether said second signal is received within said microprocessor after step n) before receiving said first signal again.

7. The method of claim 2, additionally comprising steps of:

p) resetting a numeric indicator in response to a determination made in step c) that said stream of water has not moved across said second location after moving across said first location;

i) driving said numeric indicator to indicate a count of determinations made in step c) that said stream of water has moved across said second location following 14 step p).

8. Apparatus for use in a game of jumping a rotating stream of water from a sprinkler as said stream of water moves across a player position, wherein said apparatus comprises:

a first sensor at a first location, wherein said first sensor generates a first signal in response to movement of said stream of water across said first location;

a second sensor at a second location, wherein said second sensor generates a second signal in response to movement of said stream of water across said second location;

an indicator for generating a human perceivable indication; and a microprocessor receiving said first and second signals; and a program executing within said microprocessor to determine whether said stream of water moves across said second location after moving across said first location in response to receiving said first and second signals and to drive said indicator to generate said human perceivable indication in response to determining determine whether said stream of water moves across said second location after moving across said first location.

9. The apparatus of claim 8, wherein said program repeatedly determines whether said stream of water moves across said second location after moving across said first location in response to receiving said first and second signals and repeatedly drives said indicator to generate said human perceivable indication in response to determining determine whether said stream of water moves across said second location after moving across said first location.

10. The apparatus of claim 9, wherein said program determines whether said stream of water moves across said second location after moving across said first location in response to receiving said first and second signals by a method including steps of:

a) receiving said first signal within said microprocessor; and b) determining whether said second signal is received within said microprocessor during an allowable actuation time after receiving said first signal.

11. The apparatus of claim 10, wherein said program determines said allowable actuation time before step a) by a method including steps of:

c) receiving said first signal within said microprocessor;

c) counting timing pulses following step c);

d) receiving said second signal within said microprocessor; and e) adding a predetermined number to a number of pulses counted between steps c) and d) to determine a number of timing pulses occurring during said allowable actuation time.

12. The apparatus of claim 11, wherein step c) is preceded by a method providing time for said sprinkler to reach a steady rotational speed comprising steps of f) receiving said first signal; and g) receiving said second signal.

13. The apparatus of claim 9, wherein said program determines whether said stream of water moves across said second location after moving across said first location in response to receiving said first and second signals by a method including steps of:

h) receiving said first signal;

i) determining that said first signal has ended; and j) determining whether said second signal is received after step i) before receiving said first signal again.

14. The apparatus of claim 9, additionally comprising a numeric indicator, wherein said program additionally comprises steps of:

k) resetting said numeric indicator in response to a determination that said stream of water has not moved across said second location after moving across said first location;

l) driving said numeric indicator to indicate a count of determinations that said stream of water has moved across said second location following step k).

15. The apparatus of claim 8, additionally including a housing, wherein said first and second sensors and said microprocessor are mounted within said housing, said first sensor includes a microphone generating said first signal in response to said water stream striking said housing adjacent said first location, and said second sensor includes a microphone generating said second signal in response to said water stream striking said housing adjacent said second location.

16. The apparatus of claim 15, wherein said housing includes a base housing and a sliding housing, mounted to slide relative to said base housing into a open position extending outward from said base housing said first sensor is mounted within said sliding housing, and said second sensor is mounted within said base housing.

17. The apparatus of claim 16, additionally including a battery and a switch within said housing, wherein said switch is closed to supply electrical power to said microprocessor from said battery by sliding said sliding housing relative to said base housing into said open position, and said switch is opened to terminate power to said microprocessor by sliding said sliding housing relative to said base housing from said open position.

18. The apparatus of claim 17, wherein closing said switch begins an in initialization process including starting execution of said program within said microprocessor.

19. The apparatus of claim 8, wherein said indicator generates an audible indication.

20. The apparatus of claim 8, wherein said indicator generates a visible indication.

* * * * *